United States Patent [19]

Mijala

[11] 4,394,977

[45] Jul. 26, 1983

[54] METHOD FOR IMPROVING THE UTILIZATION OF HEAT ENERGY PRODUCED IN A WOOD GRINDING PROCESS

[75] Inventor: Ari A. M. Mijala, Tempere, Finland

[73] Assignee: Oy Tampella AB, Tampere, Finland

[21] Appl. No.: 318,095

[22] Filed: Nov. 4, 1981

[30] Foreign Application Priority Data

Nov. 18, 1980 [FI] Finland ..... 803598

[51] Int. Cl.[3] ..... B02C 19/12

[52] U.S. Cl. ..... 241/21; 241/28; 241/30

[58] Field of Search ..... 162/17, 21, 28, 46, 162/47, 234, 248; 241/24, 28, 30, 33, 21, 23, 282

[56] References Cited

U.S. PATENT DOCUMENTS

| | | | |
|---|---|---|---|
| 4,012,279 | 3/1977 | Selander et al. | 241/28 X |
| 4,235,665 | 11/1980 | Reinhall et al. | 241/28 X |
| 4,236,959 | 12/1980 | Reinhall | 241/28 X |
| 4,270,703 | 6/1981 | Haikkala | 241/28 X |
| 4,324,612 | 4/1982 | Lindahl | 241/28 X |
| 4,326,913 | 4/1982 | Mattson | 241/28 X |

FOREIGN PATENT DOCUMENTS 7411949 6/1980 Sweden .

*Primary Examiner*—Mark Rosenbaum
*Attorney, Agent, or Firm*—Ladas & Parry

[57] ABSTRACT

A method for improving the utilization of the heat energy produced in a wood grinding process, wherein wood is ground in a grinding space (3) under a pressure exceeding atmospheric pressure, and warm shower water (G) is sprayed into the grinding space. The groundwood pulp (A) is fed from the grinding space into a steam separator (11), wherein the heat energy contained in the groundwood pulp is released in the form of steam (H), and replacement water (E) is brought into the process for the compensation of shower water losses. The steam separator is kept pressurized in order to recover the steam (H) released from the groundwood pulp under a greater pressure and at a higher temperature than in an atmospheric steam separator. The water addition (E) to the recovered shower water is warmed up by means of the pulp suspension (B) discharged from the steam separator, whereby the pressure of the steam is decreased from the pressure of the pulp suspension entering the steam separator only so much as is required for heating the replacement water to a temperature which will bring the shower water to the desired temperature after the replacement water has been mixed with said recovered shower water.

5 Claims, 1 Drawing Figure

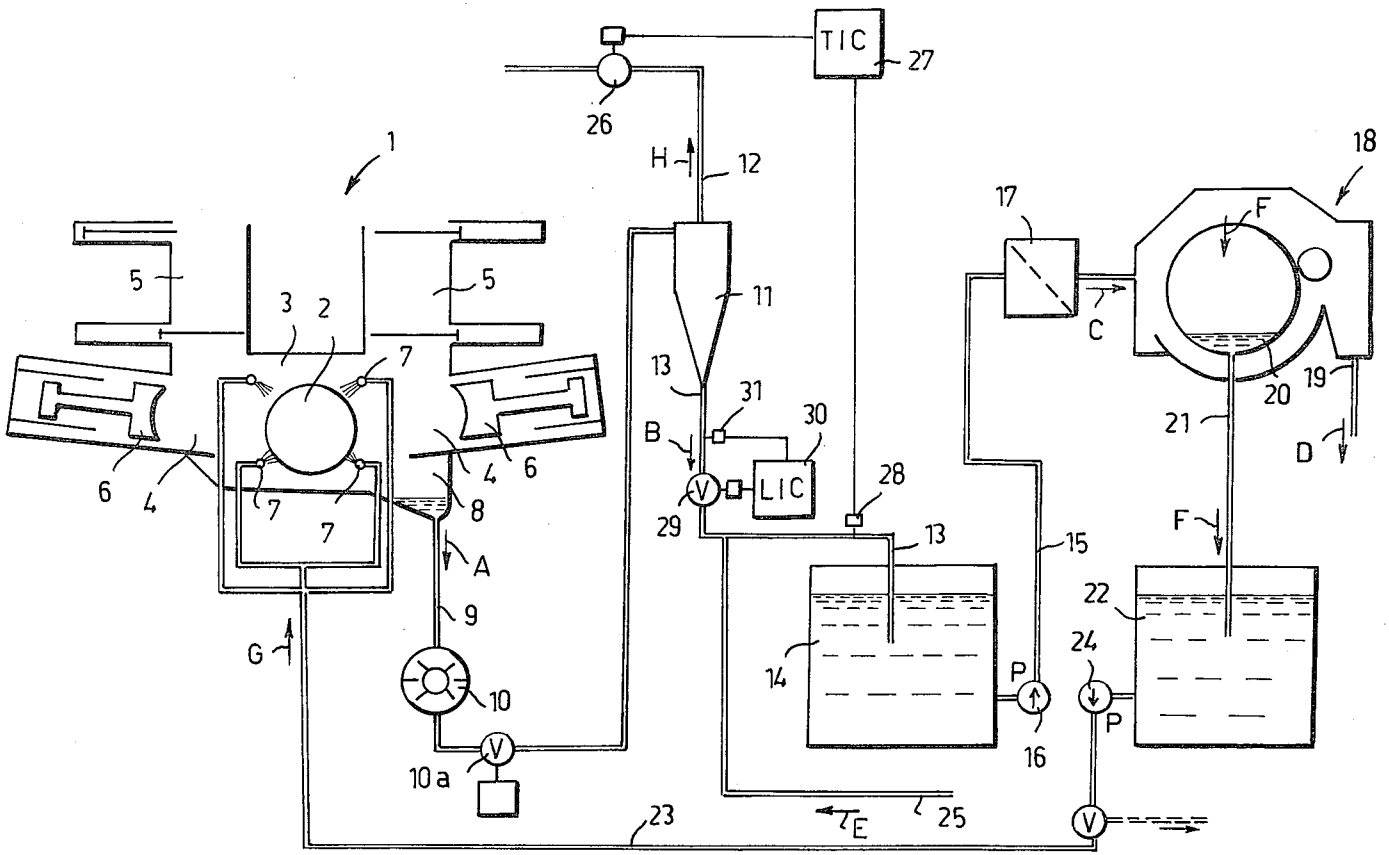
TIC
LIC
P
P
V
V
V
A
B
C
D
E
F
F
G
H

METHOD FOR IMPROVING THE UTILIZATION OF HEAT ENERGY PRODUCED IN A WOOD GRINDING PROCESS

This invention relates to a method for improving the utilization of the heat energy produced in a wood grinding process. According to this method

- wood is ground by means of a rotating grinding member in a grinding space under a pressure exceeding atmospheric pressure,
- warm shower water is sprayed into the grinding space,
- groundwood pulp is conveyed from the grinding space into a steam separator wherein the heat energy contained in the groundwood pulp is released in the form of steam,
- the groundwood pulp is brought from the steam separator into a thickener from which removed water is brought back into the grinding space as shower water,
- water is added to the shower water, and
- steam released in the steam separator is recovered for further use.

Pressurized grinding is known (Finnish patent applications 782414, 780514, 780515, Swedish patent application No. 7411949-6 and Swedish Pat. Nos. 318178 and 336952) in which wood is ground in a grinding space under a pressure exceeding atmospheric pressure. Wood is fed into the pressurized grinding space for example by means of pressure equalizing chambers built above the grinding pockets of the grinder. The grinding space, defined by gates and a pulp pit, is pressurized preferably with air or steam. The defibration takes place by pressing wood blocks by a hydraulic piston against the grinding stone. Vibration caused by the grinding stone, heat caused by friction and shower water sprayed on the grinding stone separate the fibers from the wood material.

It has been found that in pressurized grinding the temperature of shower water has greater influence on the defibration than under atmospheric pressure. The warmer the shower water, the longer and more unbroken are the fibers separated from the wood material, and the stronger is the paper made of such fibers. Thus it is the better for the pressurized grinding, the warmer the shower water is when fed back into the grinder.

After defibration the groundwood pulp flows out from the grinding space through a pipe in which sticks and bigger slabs of wood are cut into pieces by a stick crusher before adjusting the flow rate. The temperature of the pulp discharged from the grinding space is normally more than 100° C. In practice the pulp temperature may rise up to 145° C., which depends on the temperature of the shower water and on the pressure of the grinding space. Thereby the temperature of the shower water when sprayed into the grinding space must be 130°-135° C. and the pressure in the grinding space 3 bar. Heat energy contained in the pulp suspension is released in the form of steam in a steam separator within which the pressure is decreased to atmospheric pressure, because the pulp temperature after the steam separator must be below the boiling point of water. From the steam separator the pulp can flow directly into a thickener where the hot shower water is separated from the pulp and is fed back into the grinding space. From the steam separator pulp can also be discharged into a tank from which it can be pumped to different kinds of screening, pressurized screen and hydro cleaner, before it enters a thickener where hot shower water is separated from the pulp. From this thickener pulp is discharged with a consistency of 5-33%.

In this known system the temperature of the steam relased from the steam separator is about 100° C. and the pressure about 1 bar. This low temperature and pressure decrease the amount of possible uses of the steam and lower the value of the steam. This disadvantage is especially big when a heat compressor is used for raising the temperature and the pressure of the steam.

With the pulp discharged from the thickener the system looses 2-20% of the warm shower water. This loss as well as other possible losses must be compensated by addition of water, the temperature of which is often considerably lower, usually 50°-60° C., and which in the known system is supplied to the shower water tank following and thickener. This shower water addition of low temperature decreases the total temperature of the shower water by 2°-10° C. which is a disadvantage.

In the known system the temperature of the pulp remains constant after the steam separator, but the amount and temperature of the water added into the system can vary, and they cannot be economically adjusted within the scope of a wise water economy for the plant. Thereby also the temperature of the shower water entering the grinder can vary about ±5° C. without being controllable, which is a disadvantage.

The object of this invention is to accomplish a method which eliminates the above-mentioned disadvantages and improves the usability and utilization value of the steam released from the pressure grinding process, and to improve the control of the temperatures in the process. This object is achieved by a method according to the invention, which is characterized by

- that the steam separator is pressurized in order to recover under pressure the steam released from the groundwood pulp,
- that the additional water for the shower water is after the steam separator mixed with the pulp suspension relieved of steam, and
- that the pressure of the steam released in the steam separator is adjusted so that the temperature of the pulp suspension after the water addition corresponds substantially to the desired temperature of the shower water.

The invention is based on the principle that by keeping the steam separator under pressure it is possible to supply the steam released from the steam separator for further use under a higher pressure and at a higher temperature than which has been possible when an atmospheric steam separator is used. This increases the amount of the possible uses of the steam substantially and increases thus the value of the steam.

By adjusting the pressure of the steam released from the steam separator it is possible to control the temperature of the pulp suspension discharged from the steam separator, and thus always maintain the temperature of the pulp suspension suitable in regard to the heat required for heating the additional water so that the shower water fed into the grinder is at desired temperature. This is a way to make sure that the shower water temperature does not vary substantially even if the amount and temperature of the additional water vary. Accordingly to the invention the steam released from the steam separator is recovered under the highest possible pressure, because the heat contents of the groundwood pulp leaving the steam separator is increased by decreasing the steam pressure only so much below the steam pressure corresponding to the temperature of the suspension entering the steam separator, as is required by the growing amount or decreasing temperature of the additional water.

When a heat compressor device is used for secondary treatment of the steam, considerable saving in the power requirement of the compressor is achieved if the steam is pressurized aleady before the compressor. Also the volume flow of the steam decreases and therefore the size of equipment becomes smaller.

The invention will be described in more detail in the following with reference to the accompanying drawing which shows schematically a pressure grinding process operating according to the invention.

The drawing illustrates a grinding machine 1 comprising a rotating grinding stone 2 arranged in a pressurized grinding space 3. The grinding space comprises two grinding pockets 4 above which there are earlier known pressure equalizing chambers 5 closd by closing gates. On two opposite sides of the grinding stone there are hydraulic pistons 6 for pressing blocks of wood dropped into the grinding pockets against the grinding stone. In the grinding space there is a number of shower pipes 7 to feed warm shower water to the surface of the grinding stone. For collecting the groundwood pulp there is a pulp pit 8 in the grinding space.

From the pulp pit of the grinder leads a pipe 9 for the suspension A through a stick crusher 10 and a blow valve 10*a* to a first steam separator 11 which is provided with an outlet pipe 12 for steam H1 released from the pulp. From the steam separator leads a pipe 13 for feeding the groundwood pulp, relieved of steam, to a tank 14. From the tank leads a pipe 15 through a pump 16 and a pressure screen 17 to a thickener 18 for the groundwood pulp C to be thickened. The thickener is provided with an outlet 19 for the thickened groundwood pulp D.

The thickener is provided with a pit 20 for water F removed from the groundwood pulp C to be thickened. From the pit leads a pipe 21 to a tank 22. From this tank leads a pipe 23 through a pump 24 to shower pipes 7 provided in the grinding space, for bringing warm shower water G to said shower pipes.

When groundwood pulp is produced shower water circulates continuously through a circulating system formed by pipes 9-13-15-21-23. A part of the shower water is discharged along with the thickened groundwood pulp, and due to other losses of water from the process, exhausting steam etc., more water must be added into the circulating system than the amount which escapes from the thickener with the pulp.

A part of this water is water condensed in the grinder and the rest is replacement water E which is supplied by a pipe 25 to the pipe 13 after the steam separator. The pressure in the steam separator is kept constant by discharging the steam released in the steam separator through a pressure regulating valve 26 controlled by means of a regulator 27 in accordance with the measures of a temperature sensor 28. The level of groundwood pulp in the pipe 13 following the steam separator is adjusted by a valve 29 which is controlled by a regulator 30 in accordance with the measures of a surface level sensor 31.

In the known system in which the steam separator is under atmospheric pressure the groundwood pulp is discharged from the steam separator at about 100° C. Due to losses the temperature of the shower water is decreased about 1° C. If for example 10% of the total shower water is replacement water having a temperature of +50° C., the temperature of the shower water will be: 0,1·50° C.+0,90·99° C.=94,1° C.

If the grinding plant comprises for example three grinders the steam separator evaporate about 3 kg/s steam at 100° C. and under a pressure of 1,0133 bar.

The theoretical power consumption of the heat compressor can be calculated as follows:

$$P = \dot{m}\,\frac{p_{ek}\cdot k}{\rho_{ek}(k-1)\eta_y}\cdot\left[\left(\frac{p_{ku}}{p_{ek}}\right)^{\frac{k-1}{k}} - 1\right]$$

wherein $P$=power requirement of the compressor, kW
$\dot{m}$=pulp flow, kg/s
$P_{ek}$=pressure before the compressor, kPa
$P_{ku}$=pressure after the compressor
$\rho$=gas density before the compressor, kg/m$^3$
k=thermal compressibility
$\eta_y$=mechanical efficiency of the compressor In the following the power consumption will be calculated. If the steam separator is under atmospheric pressure and if the temperature of the steam in the heat exchanger must be decreased by 5° C. in order to change the steam into pure steam, the power consumption of the compressor is as follows:

$\dot{m}$=3 kg/s
$P_{ek}$=84,5 kPa
$P_{ku}$=400 kPa
$\rho$=0,5045 kg/m$^3$
k=1,3
$\eta_y$=0,80

$$p = 3\cdot\frac{84{,}5\cdot 1{,}3}{0{,}5045\cdot 0{,}3\cdot 0{,}8}\left[\left(\frac{400}{84{,}5}\right)^{\frac{0{,}3}{1{,}3}} - 1\right] = 1179\ \text{kW}$$

When using a pressurized steam separator according to the invention the temperature of the shower water can be adjusted so that it is 100° C. after the addition of water. Thereby, using 10% replacement water at 50° C. the temperature of the pulp discharged from the steam separator is:

$$\frac{100°\ \text{C.} - 0{,}10\cdot 50°\ \text{C.}}{0{,}9} = 105{,}5°\ \text{C.}$$

Also in this case we can suppose that 5° C. of the temperature is lost in the heat exchanger which means that the temperature of the steam ready for use is 100,5° C., pressure 103,2 kPa and density 0,609. Corresponding to the above formula, the power consumption of the compressor is now:

$$p = 3\cdot\frac{103{,}2\cdot 1{,}3}{0{,}609\cdot 0{,}3\cdot 0{,}8}\left[\left(\frac{400}{103{,}2}\right)^{\frac{0{,}3}{1{,}3}} - 1\right] = 1010\ \text{kW}$$

The saving in the power consumption of the heat compressor will be about 168 kW or about 17%. The volume flow of steam decreases correspondingly about 18% which decreases also the size of the equipment.

It is evident that the steam discharged from the steam separator can be recovered for further use under higher pressure and at higher temperature than has been possible with an atmospheric steam separator, and that in spite of this the temperature of the shower water after the water addition is higher than what has earlier been possible. By regulating the steam pressure the temperature of the groundwood pulp discharged from the steam separator can be adjusted so that after the addition of water it is possible to separate in the thickener from the groundwood pulp shower water having a temperature which is suitable for the grinding space of the grinder.

EXAMPLE 1

The situation in the grinder is as follows: the amount of additional water E is 10% of the total water G and the temperature is +50° C. The desired temperature of the groundwood pulp entering the tank 14 is 100° C. The regulator 27 has adjusted the pressure regulating valve 26 to such a position that the measure of the sensor 28 corresponds to the set value 100° C. The temperature of the pulp B discharged from the steam separator 11 is now $$\frac{1 \cdot 100^\circ\text{ C.} - 0{,}1 \cdot 50^\circ\text{ C.}}{0{,}9} = 105{,}5^\circ\text{ C.}$$

Due to the warming up of the process the temperature of the additional water E increases to +60° C., whereby also the temperature of the groundwood pulp entering the tank 14 increases. The sensor 28 measures this temperature and the regulator 27 opens the valve 26 so that the pressure in the steam separator 11 decreases whereby also the temperature of the pulp B discharged from the steam separator decreases. The valve 26 remains open until the measure of the sensor 28 corresponds to the set value 100° C. of the regulator 27. Thereby the temperature of the groundwood pulp discharged from the steam separator is $$\frac{1 \cdot 100^\circ\text{ C.} - 0{,}1 \cdot 60^\circ\text{ C.}}{0{,}9} = 104{,}4^\circ\text{ C.}$$

A corresponding operation takes place if the amount of replacement water E decreases while the temperature remains unchanged or increases at the same time. Let us suppose that the amount of replacement water increases from a volume of 0,1 to a volume of 0,15 while the temperature remains at 50° C. Then the temperature of the groundwood pulp B entering the tank 14 decreases to $$\frac{0{,}9 \cdot 105{,}5^\circ\text{ C.} + 0{,}15 \cdot 50^\circ\text{ C.}}{1{,}05} = 97{,}5^\circ\text{ C.}$$

The sensor 28 measures this temperature and the regulator 27 closes the valve 26 so that the pressure and the temperature in the steam separator 11 increases. The valve remains closed until the temperature of the groundwood pulp B passing the sensor 28 is at 100° C. The temperature of the pulp discharged from the steam separator is then $$\frac{1{,}05 \cdot 100^\circ\text{ C.} - 0{,}15 \cdot 50^\circ\text{ C.}}{0{,}9} = 108{,}3^\circ\text{ C.}$$

A corresponding operation takes place if the temperature of the replacement water E decreases while the amount of replacement water remains unchanged or increases.

In addition to the use as shower water, water of suitable temperature may be needed for some other phase of the process, whereby a bigger amount of replacement water E is needed for this consumption. Such other use of warm water is shown in the drawing with broken lines 32.

It is also possible that the temperature of the shower water is over 100° C. whereby the equipment must be pressureproof.

The object of the invention and the description is only to illustrate the principle of the invention. In details the method according to the invention may vary within the scope of the claims.

What I claim is:

1. A method for improving the utilization of the heat energy produced in a wood grinding process according to which method wood is ground by means of a rotating grinding member (2) in a grinding space (3) under a pressure exceeding atmospheric pressure, warm shower water (G) is sprayed into the grinding space, groundwood pulp (A) is conveyed from the grinding space into a steam separator (11) wherein the heat energy contained in the groundwood pulp is released in the form of steam (H), the groundwood pulp is brought from the steam separator into a thickener (18) from which removed water is brought back into the grinding space as shower water (G), water (E) is added to the shower water, and steam (H) released in the steam separator is recovered for further use, characterized in that, the steam separator (11) is pressurized in order to recover under pressure the steam (H) released from the groundwood pulp (A), the additional water (E) for the shower water (G) is after the steam separator mixed with the pulp suspension (B) relieved of steam, the pressure of the steam (H) released in the steam separator is adjusted so that the temperature of the pulp suspension (B) after the water addition (E) corresponds substantially to the desired temperature of the shower water (G).

2. A method according to claim 1, characterized in that the steam (H), released in the steam separator (11) is discharged from the steam separator through a pressure regulating valve (26).

3. A method according to claim 2, characterized in that the groundwood pulp (B) relieved of steam is discharged from the steam separator (11) through a pressure lock (29–31) formed by groundwood pulp.

4. A method according to claim 2 or 3, characterized in that the pressure regulating valve (26) is controlled according to the temperature of the groundwood pulp (B) measured after the pressure lock (29–31).

5. A method according to claim 1, characterized in that the additional water (E) brought to the process corresponds to the losses of shower water.

* * * * *